US011070929B2

(12) United States Patent
Bhamla et al.

(10) Patent No.: US 11,070,929 B2
(45) Date of Patent: Jul. 20, 2021

(54) LOW-COST HEARING AID PLATFORMS AND METHODS OF USE

(71) Applicant: Georgia Tech Research Corporation, Atlanta, GA (US)

(72) Inventors: M. Saad Bhamla, Atlanta, GA (US); Soham Sinha, Atlanta, GA (US)

(73) Assignee: GEORGIA TECH RESEARCH CORPORATION, Atlanta, GA (US)

( * ) Notice: Subject to any disclaimer, the term of this patent is extended or adjusted under 35 U.S.C. 154(b) by 160 days.

(21) Appl. No.: 16/374,171

(22) Filed: Apr. 3, 2019

(65) Prior Publication Data

US 2019/0306638 A1 Oct. 3, 2019

Related U.S. Application Data

(60) Provisional application No. 62/651,912, filed on Apr. 3, 2018.

(51) Int. Cl.

| | |
|---|---|
| ***H04R 25/00*** | (2006.01) |
| ***H04R 19/01*** | (2006.01) |
| ***H04R 19/04*** | (2006.01) |

(52) U.S. Cl.

CPC ..... *H04R 25/658* (2013.01); *H04R 19/01* (2013.01); *H04R 19/04* (2013.01); *H04R 25/602* (2013.01); *H04R 25/604* (2013.01); *H04R 2225/57* (2019.05)

(58) Field of Classification Search

CPC .... H04R 5/033; H04R 2460/01; H04R 25/00; H04R 25/43; H04R 25/558; H04R 25/50; H04R 25/305; H04R 25/554

See application file for complete search history.

(56) References Cited

U.S. PATENT DOCUMENTS 5,608,803 A * 3/1997 Magotra ..... H04R 25/552 381/312
5,710,820 A * 1/1998 Martin ..... H04R 25/356 381/321
5,818,946 A * 10/1998 Walter ..... H04R 25/602 381/321

OTHER PUBLICATIONS

MAX9814 Evaluation Kit, 2007, Table 3.*

* cited by examiner

*Primary Examiner* — Amir H Etesam

(74) *Attorney, Agent, or Firm* — Troutman Pepper Hamilton Sanders LLP; Ryan Schneider; Christopher Close

(57) ABSTRACT

Low-cost hearing aid platforms that are customizable for specific user needs are disclosed. An exemplary hearing aid platform includes an electret microphone, an amplifier, a capacitor, a printable circuit board (PCB), an audio output, and a housing for the components. The hearing aid platform may comprise customizable gain settings and safety features such as automatic gain control. In some embodiments, the hearing aid platform may connect to headphones. In some embodiments, the hearing aid platform may connect to a bone transducer. Devices described herein also may include housings that are customizable for a user's needs and/or personality.

24 Claims, 9 Drawing Sheets

LOW-COST HEARING AID PLATFORMS AND METHODS OF USE

CROSS-REFERENCE TO RELATED APPLICATIONS

This Application claims priority to U.S. Provisional Patent Application No. 62/651,912, filed 3 Apr. 2018, which is hereby incorporated by reference herein in its entirety as if fully set forth below.

FIELD OF THE DISCLOSURE

Embodiments of the present disclosure relate generally to hearing aid platforms and, more particularly, to low-cost hearing aid platforms that are customizable for specific user needs.

BACKGROUND

According to the World Health Organization, as much as 7% of the world's population has some form of disabling hearing loss. The majority of this population subset is concentrated in low-income, low-resource regions in South Asia, South Pacific, and Sub-Saharan Africa. For adults over 65 years of age, hearing loss affects close to one third of the entire global population. In the United States, approximately 10% of the population has some form of hearing loss, and that number includes two-thirds of the U.S. population over 70 years of age. The impact of hearing loss is understated, particularly in social settings. The symptoms and results of untreated hearing loss have been linked to feelings of isolation, depression, anxiety, reduced language comprehension and/or language ability, impaired memory and/or reduced cognitive input, denial, defensiveness, negativity, and distrust. Despite the prevalence of hearing loss and the problems associated therewith, the condition has been mainly overlooked by policymakers interested in public health.

Age Related Hearing Loss (ARHL), which affects individuals over 65 years, is a common form of hearing loss. ARHL is a condition that develops gradually over time and is difficult to pinpoint to a certain cause. Possible causes include repeated or prolonged exposure to high-decibel noise, high blood pressure, diabetes, and use of certain medications such as chemotherapy drugs. Certain physical abnormalities can also cause ARHL, such as stiffening of the tympanic membrane (eardrum), which makes the membrane less responsive to vibrations at high frequencies (>4000 Hz). Despite the cause of ARHL, the disease has a very particular and recognizable audiological pattern. People with ARHL show little to no decibels Hearing Level (dB HL) loss in the low frequency range, but starting at 1000 Hz, the average person experiences a sloping level of increasing dB HL loss up to 8 kHz.

Currently, the medically accepted nonsurgical treatment for ARHL includes the use of hearing aids. Hearing aids amplify sound in certain regions of the audiological profile to produce sound at a level which, when combined with the acoustical profile of the patient, simulates a healthy ear. Although not a cure, the hearing aid helps to avoid the subsequent cognitive decline that comes with hearing loss. However, more than two-thirds of adults with hearing loss avoid wearing hearing aids.

The reasons for poor uptake are varied and include cost and social stigma of wearing a hearing aid—the largest factor being cost. Hearing aid costs have risen steadily over the years, showing an almost three-fold increase for a Behind-the-Ear (BTE) hearing aid in the period from 1989-2008 in the United States. Current prices for BTE hearing aids range from $500 to over $3,000. Even in high income, wealthy countries, adoption of hearing aids remains low because the largest cohort of those who need hearing aids (individuals over 65 with ARHL), are members of the low-income groups of society.

Recently, the United States passed the Over-the-Counter Hearing Aid Act as part of the Food and Drug Administration Reauthorization Act of 2017. The new law aims to allow certain hearing aids to be available over-the-counter to individuals with mild hearing loss, and the law also requires the Food and Drug Administration to recreate the entire framework and market for hearing aids. It is clear, therefore, that certain policymakers are concerned with the lack of access to hearing aids and are perhaps also concerned with the thousand-dollar price tag for many devices.

The number of individuals who wear hearing aids is also low because of the inherent design of the devices. For example, most BTE hearing aids are quite large and stick out from the wearer's head. The wearer, therefore, must not only deal with the stigma of the hearing impairment but must also deal with displaying the impairment to others by wearing a cumbersome device. What is needed, therefore, is a platform that is cost effective, such that low-income individuals, particularly those low-income individuals in developing countries, have access to these important technologies. A desired platform is customizable based on the particular needs of the patient. Finally, a desired platform is also customizable based on the particular personality of the individual, so the social stigma of wearing the device is at least partially removed.

SUMMARY

Embodiments of the present disclosure address these concerns as well as other needs that will become apparent upon reading the description below in conjunction with the drawings. Briefly described, embodiments of the present disclosure relate generally to hearing aid platforms and, more particularly, to low-cost hearing aid platforms that are customizable for specific user needs.

An exemplary embodiment of the present invention provides a device. The device may consist of an electret microphone, an amplifier, a capacitor, a printable circuit board (PCB), an audio output, a power source, and a housing. The electret microphone, the amplifier, and the capacitor may be disposed upon the PCB. The audio output may be in electrical communication with the amplifier. The power source may be in electrical communication with the PCB. The housing may contain one or more of the electret microphone, amplifier, capacitor, PCB, audio output, and power source.

In any of the embodiments described herein, the power source may supply a voltage of from between approximately 3.0V and approximately 4.5V.

In any of the embodiments described herein, the power source may be one or more batteries.

In any of the embodiments described herein, the microphone may have an attack/release ratio of from between 1:500 and 1:2000.

In any of the embodiments described herein, the audio output may be an audio jack configured to output a signal to headphones.

In any of the embodiments described herein, the audio output may be configured to output a signal to a bone transducer.

In any of the embodiments described herein, the housing may form a wearable device, wherein the wearable is one of a necklace, a neck band, glasses, or a hat.

In any of the embodiments described herein, a total harmonic distortion of the device, when the microphone is subjected to a 70 dB sound input, may be less than 1% at each of 500 Hz, 800 Hz, and 1500 Hz.

Another exemplary embodiment of the present invention provides a device. The device may comprise an electret microphone, an amplifier, a capacitor, and a printable circuit board (PCB). The electret microphone, the amplifier, and the capacitor may be disposed upon the PCB. The device may further comprise an audio output in electrical communication with the amplifier. The device may further comprise a power source in electrical communication with the PCB. In any embodiment described herein, the device may not have a digital signal processor.

In any of the embodiments described herein, the power source may supply a voltage of from between approximately 3.0V and approximately 4.5V.

In any of the embodiments described herein, the power source may be one of one or more double-A batteries, one or more triple-A batteries, or a lithium ion polymer battery.

In any of the embodiments described herein, the microphone may have an attack/release ratio of from between 1:500 and 1:2000.

In any of the embodiments described herein, the audio output may be a headphone jack. The device may further comprise headphones in electrical connection with the headphone jack.

In any of the embodiments described herein, the audio output may be in electrical connection with a bone transducer.

In any of the embodiments described herein, a total harmonic distortion of the device, when the microphone is subjected to a 70 dB sound input, may be less than 1% at each of 500 Hz, 800 Hz, and 1500 Hz.

Another exemplary embodiment of the present invention provides a method. The method may comprise providing a printable circuit board (PCB). The method may further comprise providing an electret microphone comprising a voltage output. The method may further comprise providing an amplifier comprising a voltage input and a voltage output. The method may further comprise attaching the electret microphone and the amplifier to the PCB. The method may further comprise connecting, via a capacitor, the voltage output of the electret microphone to the voltage input of the amplifier. The method may further comprise connecting an audio output to the voltage output the amplifier. The method may further comprise providing a power source. The power source may be configured to supply voltage to the electret microphone and the amplifier. The power source may comprise at least one of a double-A battery, a triple-A battery, or a lithium ion polymer battery. The method may further comprise providing a housing comprising an internal cavity. The PCB, the electret microphone, and the amplifier may be disposed within the internal cavity of the housing.

In any of the embodiments described herein, the audio output may be an audio jack comprising a female-end receptacle. The audio jack may be disposed at least partially within the internal cavity of the housing. The female-end receptacle may extend at least partially from the internal cavity and through the housing.

In any of the embodiments described herein, the housing and the audio jack may be water resistant.

In any of the embodiments described herein, the housing may comprise a three-dimensional printed polymer.

In any of the embodiments described herein, the microphone may have an attack/release ratio of from between 1:500 and 1:2000.

These and other aspects of the present disclosure are described in the Detailed Description below and the accompanying figures. Other aspects and features of embodiments of the present disclosure will become apparent to those of ordinary skill in the art upon reviewing the following description of specific, example embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while example embodiments may be discussed below as device, system, or method embodiments, it is to be understood that such example embodiments can be implemented in various devices, systems, and methods of the present disclosure.

BRIEF DESCRIPTION OF THE FIGURES

Reference will now be made to the accompanying figures and diagrams, which are not necessarily drawn to scale, and wherein.

DETAILED DESCRIPTION

Figure 1:
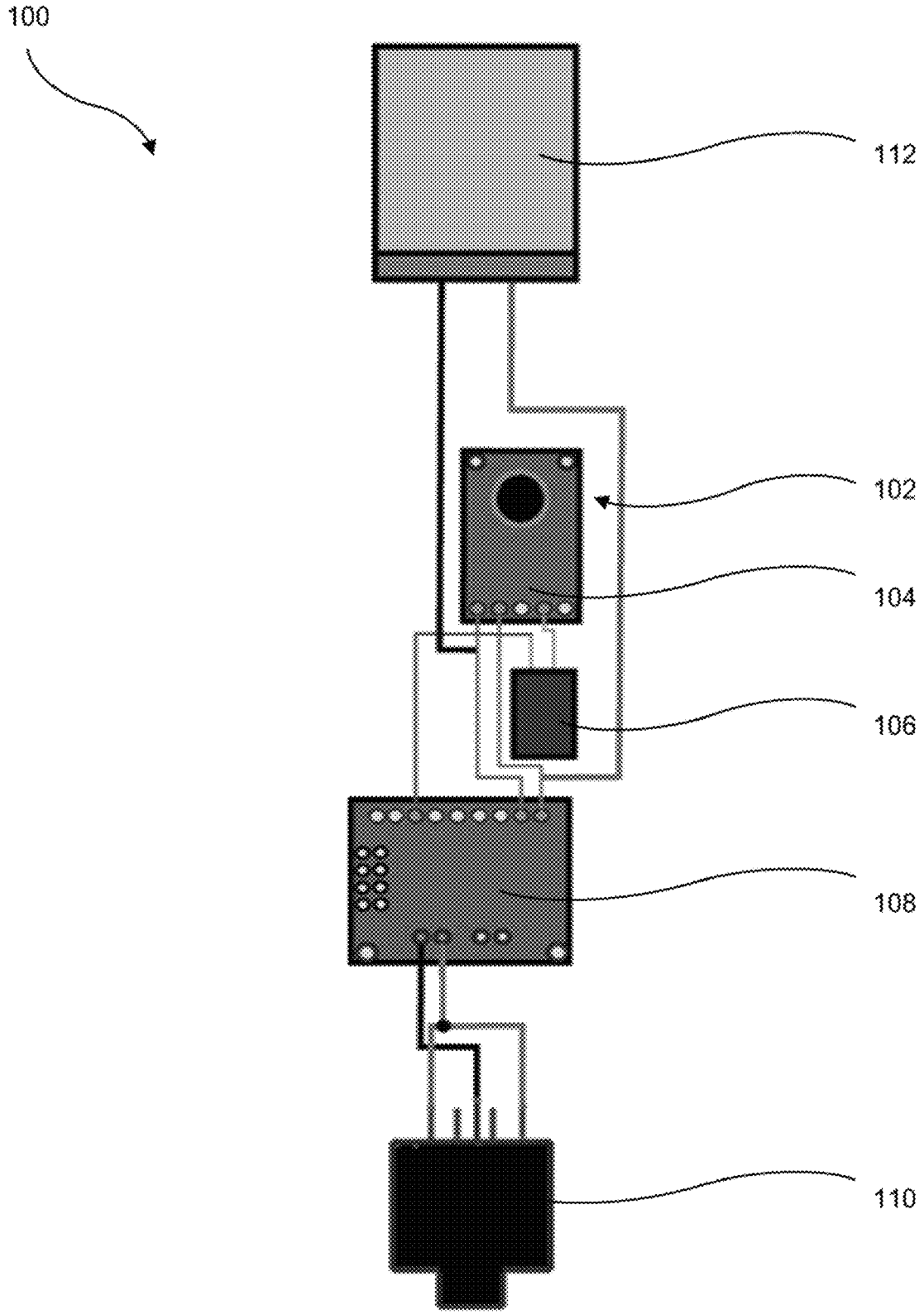
FIG. 1 is a schematic of an exemplary low-cost hearing aid platform, according to an exemplary embodiment of the present invention.

Although certain embodiments of the disclosure are explained in detail, it is to be understood that other embodiments are contemplated. Accordingly, it is not intended that the disclosure is limited in its scope to the details of construction and arrangement of components set forth in the following description or illustrated in the drawings. Other embodiments of the disclosure are capable of being practiced or carried out in various ways. Also, in describing the embodiments, specific terminology will be resorted to for the sake of clarity. It is intended that each term contemplates its broadest meaning as understood by those skilled in the art and includes all technical equivalents which operate in a similar manner to accomplish a similar purpose.

It should also be noted that, as used in the specification and the appended claims, the singular forms "a," "an" and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

To facilitate an understanding of the principles and features of the disclosure, various illustrative embodiments are explained below. In particular, the presently disclosed subject matter is described in the context of hearing aid platforms and, more particularly, to low-cost hearing aid platforms that are customizable for specific user needs. The present disclosure, however, is not so limited and can be applicable in other contexts. For example, some embodiments of the present disclosure may improve the functionality of other amplification systems outside of the context of hearing aids. Accordingly, when the present disclosure is described in the context of hearing aid platforms, it will be understood that other embodiments can take the place of those referred to.

As described above, hearing loss is a condition that is highly prevalent—studies show as much as 7% of the world population experiences some form of hearing loss. However, despite the prevalence of the impairment, less than 25% of those who could benefit from using a hearing aid actually adopt the use of the device. This number is even lower, as low as 2%, in many Asian countries, including India and China. The reasons for this low adoption rate include cost of the devices and the social stigma of wearing the devices.

Cost may be the most prohibitive characteristic of hearing aids. Current designs cost as much as several thousand U.S. dollars. Despite the fact that costs for microprocessors and electronics have decreased steadily in the last 30 years, prices of hearing aids have not decreased. Thus, there is a need for a fresh, new approach for re-inventing the hearing aid, taking cost into account but without compromising on acoustic performance.

Another prohibitive characteristic of hearing aids is the social stigma associated with the devices. Most current devices are Behind-the-Ear (BTE) systems. The systems include directional microphones, housings, and battery compartments that all must reside behind the ear. This large and cumbersome package of components stick out from behind the ear of the wearer, thereby displaying the impairment to the world. Also, the package of components is ordinarily not robust, durable, and/or waterproof. This means that the user may be hesitant to wear the hearing aid at all times for fear of damaging the expensive device. As described above, untreated hearing loss has shown to be linked to feelings of isolation, depression, anxiety, reduced language comprehension and/or language ability, impaired memory and/or reduced cognitive input, denial, defensiveness, negativity, and distrust. A desired hearing aid is, therefore, robust and durable so the wearer is inclined to wear the device at any time sound amplification is needed.

It is clear from audiological literature that there is unmet need for people with hearing loss across the globe. The World Health Organization estimates the current production of hearing aids meets less than 10% of the global needs. Hearing devices have always been conceptualized as having optimal functionality and resulting in optimal outcome, without taking cost into account. Thus, there is a need to reconceptualize hearing devices keeping the cost/benefit/access analysis in mind. Current direct-to-consumer devices seek to provide inexpensive amplification of sounds. However, these current systems produce poor acoustic quality and do not provide the amplification characteristics necessary for the largest subset of people with hearing loss—individuals with Age Related Hearing Loss (ARHL). People with ARHL show little to no decibels Hearing Level (dB HL) loss in the low frequency range, but starting from 1000 Hz, the average person experiences a sloping level of increasing dB HL loss up to 8 kHz. Current affordable direct-to-consumer devices tend to have too high of gain in the low frequency region (<500 Hz) and too little gain in the high frequency region (>3 kHz).

Other preferred characteristics for hearing aids exist beyond having appropriate gain to address the audiologic profile of ARHL. The World Health Organization published preferred acoustic performance parameters for hearing aids in the report "Preferred profile for hearing-aid technology suitable for low- and middle-income countries," Geneva 2017. Table 1 shows certain preferred hearing-aid characteristics cited by the WHO.

TABLE 1

| Parameter | Recommendation |
|---|---|
| Maximum OSPL 90 | 100-130 dB SPL ± 4 dB |
| OSPL 90 at 1 kHz | 90-124 dB SPL ± 4 dB |
| Total Harmonic Distortion at 70 dB SPL input | 500 Hz <8%<br>800 Hz <8%<br>1500 Hz <2% |
| Equivalent Input Noise | <30 dB SPL @ 1 kHz |
| Battery Current Drain | ≤1 mA |
| Battery Life | 2-3 weeks |

Accordingly, a low-cost hearing aid platform should aim to match these recommended protocols as close as possible to provide the wearer with an optimal hearing-aid experience.

Embodiments of the present disclosure provide a platform that addresses the aforementioned issues and considerations. Exemplary embodiments of the present disclosure describe robust and low-cost hearing aid platforms that are customizable for specific user needs. As will be described herein, certain embodiments of the present systems and devices may include (1) an electret microphone, (2) an amplifier, (3) a capacitor, (4) a printable circuit board (PCB), (5) an audio output, and (6) a housing for the components. Certain embodiments of the devices described herein also provide a hearing aid platform that is available to low-income segments of society. Unlike the thousand-dollar hearing aids currently on the market, the devices described herein can be much less expensive to manufacture. For example, certain embodiments can be manufactured for less than $20.00, and some embodiments can be manufactured for as little as $2.00 (or even less). This is made possible, in part, by the removal of certain costly components contained in many conventional hearing aids. Rather, than employ these costly components, certain embodiments make use of much less costly components in specific configurations described herein to still achieve desired performance characteristics for hearing aids.

Various devices and methods are disclosed for providing these hearing aid platforms, and exemplary embodiments of the devices and methods will now be described with reference to the accompanying figures.

FIG. 1 is a schematic of an exemplary low-cost hearing aid platform 100, according to an exemplary embodiment of the present disclosure. In some embodiments a hearing aid platform 100 may comprise an electret microphone 102. An electret microphone 102 may be selected due to the device's low-power consumption as the microphone requires no polarization voltage. This low-power consumption may allow the hearing aid platform 100 to extend its battery life to well beyond the two-week recommended battery life of a device. In some embodiments, an electret microphone 102 may comprise a preamplifier. Though a preamplifier may require a small energy source, the preamplifier may be used to provide a fixed gain for an output signal of the electret microphone 102. Additionally, in some embodiments, the preamplifier may be configured to provide a first fixed gain for an output signal of the electret microphone 102, when the output signal is at a first frequency, and a second fixed gain, which is greater than the first fixed gain, when the output signal is at a second frequency, which is greater than the first frequency.

In some embodiments, an electret microphone 102 may comprise a microphone chip 104. The microphone chip 104 may be used to provide additional features that may be customizable for a particular wearer's needs. An example of customizable settings would be providing multiple gain settings for the hearing aid platform 100. Many inexpensive electret microphones 102 provide multiple, selectable gain settings. For example, an electret microphone 102 may comprise an output amplifier. The output amplifier may provide selectable gains, which, in combination with a preamplifier, may further increase the output of the device. In some embodiments, selectable gain levels may be achieved by connecting a gain pin to different voltage sources, for example to ground, to a positive voltage supply, etc. In these embodiments, a wearer may be able to adjust the amount of sound amplification simply by changing the electrical connections of the electret microphone 102. In some embodiments, an electret microphone 102 may provide selectable gains through the use of a manual switch. It is contemplated that an electret microphone 102 may have maximum gain output of from between approximately 20 dB and 100 dB. Again, a preamplifier, an output amplifier, or a combination thereof may achieve this gain. Also, similar to the preamplifier discussed above, the output amplifier may provide for gain variance across different frequencies, e.g., a higher gain at lower frequency inputs and a higher gain at higher frequency inputs, and vice versa.

In some embodiments, a microphone chip 104 may provide additional customizable features. These additional features may include, but are not limited to, safety measures for the device. Many inexpensive electret microphones 102 provide automatic gain control. Automatic gain control is used to detect when an output voltage of the microphone chip 104 exceeds a preset maximum. In other words, the automatic gain control protects users from sudden surges of loud sounds. If the output voltage exceeds the preset maximum, the microphone chip 104 may automatically reduce the gain to a lower default gain, by 20-40 dB for example. The time that the microphone chip 104 takes to sense the excess voltage and reduce the gain is called an "attack" time. The microphone chip 104 may then hold the output voltage at the reduced gain for a certain amount of time before the gain gradually increases back to the original gain setting. The time the microphone chip 104 takes to return to the original gain setting is called the "release" time. A short attack time may be used to react more quickly to sudden increases in sound levels, and a long attack time may be used to react only to prolonged high-intensity sounds, for example at a train station or in loud crowds. The ratio between the "attack" time and the "release" time is known as the attack/release ratio. For example, a device may have an attack/release ratio of 1:500, which means that if a device comprises an attack time of 1 ms, the release time is 500 ms. In some embodiments, a microphone chip 104 may include preset attack/release ratios that may be adjusted based on logic.

In some embodiments, a capacitor 106 may be used to adjust the automatic gain control of a hearing aid platform 100. As will be appreciated, in certain embodiments a microphone chip 104 may comprise preset attack/release ratios that may be adjusted by altering the voltage applied to a microphone chip 104 at an attack/release logic input. An example of this is a microphone chip 104 that provides a first attack/release ratio of the logic input is connected to ground, a second attack/release ratio if the logic input is attached to a positive voltage supply, etc. In some embodiments, the attack time may be adjusted by changing the capacitance between the logic inputs and the voltage supply. For example, an attack time may be increased by increasing the capacitance rating of a capacitor 106 placed between the logic input for the attack/release ratio and the voltage supply.

As described above, increasing the attack time will increase the release time in accordance with the selected attack/release ratio.

The ability to adjust the attack/release ratio and/or the attack time may provide a significant improvement over other low-cost amplification systems. An example of the utility of this customization is where a wearer who lives in a city with high noise pollution wishes to increase the attack time (to limit excessive gain) and to increase the attack/release ratio (to maintain a longer period of decreased gain). It is contemplated that an electret microphone 102 may provide an attack/release ratio of from between 1:1 and 1:4000. It is contemplated that an electret microphone 102 may provide an attack time of from between 0.1 milliseconds and 4 seconds. Also, a capacitor 106 may have a capacitance rating that corresponds to the desired attack time. Accordingly, it is contemplated that a capacitor 106 may have a capacitance of from between 40 nF and 1800 μF.

As described herein, an electret microphone 102 may comprise one or more of adjustable gain settings and automatic gain control. The cost of electret microphones 102 having these characteristics can range anywhere from between approximately $0.20 and approximately $8.00. Additionally, the cost of the capacitors 106 described herein can range anywhere from between approximately $0.04 and approximately $0.50. These components, therefore, are not overly prohibitive for individuals within the low-income segments of society.

In some embodiments a hearing aid platform 100 may comprise an amplifier 108.

An amplifier 108 may be used to further increase the gain of the signal coming from the electret microphone 102 and/or to increase the power of the signal. In some embodiments, an amplifier 108 may be provided if the electret microphone 102 does not comprise a preamplifier or an output amplifier. In other embodiments, an amplifier 108 may be provided if the electret microphone 102 comprises a preamplifier and/or an output amplifier.

In some embodiments, an amplifier 108 may be a Class D amplifier. A Class D amplifier may be beneficial to a hearing aid platform 100 because of the efficiency of the system. As described above, one recommended parameter of a hearing aid platform 100 is that the device has a battery life of over two weeks. In a Class D amplifier system, little energy is wasted because the device operates similar to a switch: the output is either fully on or fully off. The efficiency of these systems can be higher than 90%. The little power that is lost is when the voltage switches between on and off. Accordingly, these types of amplifiers may help to ensure a longer battery life for the hearing aid platform 100. It is contemplated that other Classes of amplifiers may also be used within the present systems.

The cost of the amplifiers 108 described herein can range anywhere from between approximately $0.50 and approximately $10.00. Including an amplifier 108 in the hearing aid platform 100, therefore, does make the device overly cost prohibitive for low-income individuals.

It should be noted that the signal outputs described herein, either from the electret microphone 102 or the amplifier 108, are not processed via digital signal processors. Traditional hearing aids process the signals to complete a variety of transformations on the audio signal. These transformations may include noise reduction, compression, speech enhancement, and/or feedback reduction. Although signal processing may be useful for certain applications, the processing also come with an increased cost. Current devices in the several-thousand-dollar range include digital signal processors. The presently describe systems and devices, however, are capable of producing customizable audio signals without the use of digital signal processors. For example and as described above, the present systems provide selectable gain and automatic gain control without the use of an additional signal processor, thereby lowering the cost of the device.

In some embodiments, a hearing aid platform 100 may comprise an audio output 110. The audio output 110 may be in electrical communication with the amplifier 108 such that the output signal may be converted into a source of sound for the wearer. In some embodiments, the audio output 110 may be an audio jack that accepts an audio connector. An audio connector may include a ¼ inch audio connector, a 3.5 mm audio connector, an optical connector, an RCA connector, a banana connector, and the like. The audio output 110 may be a female-end receptacle of the audio connector. In some embodiments, a user of the hearing aid platform 100 may receive the amplified sound from the device by connecting a hearing device with the audio jack. The hearing device may include headphones, and the audio connector can be a headphone jack corresponding to a male connector of the headphones.

In some embodiments, the audio output 110 may be waterproof or water resistant. As described above, users of hearing devices should be encouraged to wear the device when needed without fear of damaging the device. A waterproof or water-resistant audio output 110 (e.g., a water-resistant audio jack) may alleviate some concern with device durability. Exemplary waterproof audio jacks with waterproof ratings of IP67 or better can be purchased for as low as $3.00. However, it is not required that an audio output 110 is waterproof or water resistant. In some embodiments, the audio output 110 may be in direct electrical connection with the electret microphone 102 and/or the amplifier 108. For example, some embodiments do not comprise an audio jack for accepting an external hearing device, but, instead, the hearing device may be directly connected to the pins of the electret microphone 102 and/or the amplifier 108.

In some embodiments, the audio output 110 may be in electrical connection with a bone transducer. The most common hearing aid mechanism is a basic microphone-amplifier system in the ear canal. However, the ear canal is not the only way to "hear." Another method is to send vibrations through the temporal bone (behind the ear) of the skull so that vibrations are received by the cochlea, which then transforms vibrations into an auditory signal. An audio output 110 that is in electrical connection with a bone transducer allows the hearing aid platform 100 to be incorporated into glasses, a headband, a hat, or other device that may contact the temporal bone of the wearer. This may also reduce the social stigma of wearing the device, further encouraging hearing aid adoption.

In some embodiments, a hearing aid platform 100 may comprise a power source 112. A voltage provided by the system will depend upon the voltage requirements of the electret microphone 102 and/or the amplifier 108. For example, if electret microphone 102 and/or the amplifier 108 are configured to run on a voltage of from between 2.5V and 5.5V, the power source 112 may provide a voltage within that range. As described throughout this disclosure, one of the key concerns for a hearing aid platform 100 is to both be affordable and accessible. Accordingly, it is contemplated that the power source 112 may comprise common, affordable batteries. The power source 112 may include double-A batteries, triple-A batteries, lithium ion polymer batteries, and/or similar off-the-shelf batteries. These batteries are capable of providing the voltage requirements for common electret microphones 102 and amplifiers 108. For example, a common lithium ion poly battery provides a voltage of 3.7V. Common alkaline double-A and triple-A batteries provide a voltage of either 1.2V or 1.5V. Two 1.5V batteries in series provides 3.0V, and three 1.5V batteries in series provides 4.5V. Three 1.2V batteries in series provides 3.6V, and four 1.2V batteries in series provides 4.8V. It should be noted that a coin-cell (or button) battery may also provide a voltage within the range described above, for example approximately 3.0V. However, it is not preferred that the power source 112 comprise coin-cell batteries. As described herein, the largest demographic of people requiring a hearing aid are those with Age Related Hearing Loss (ARHL), which affects individuals over 65 years. Coin-cell batteries are difficult to handle for much of this demographic, as shown by the variety of packaging available for coin cells to make it easier for the elderly to handle the small battery.

Figure 2:
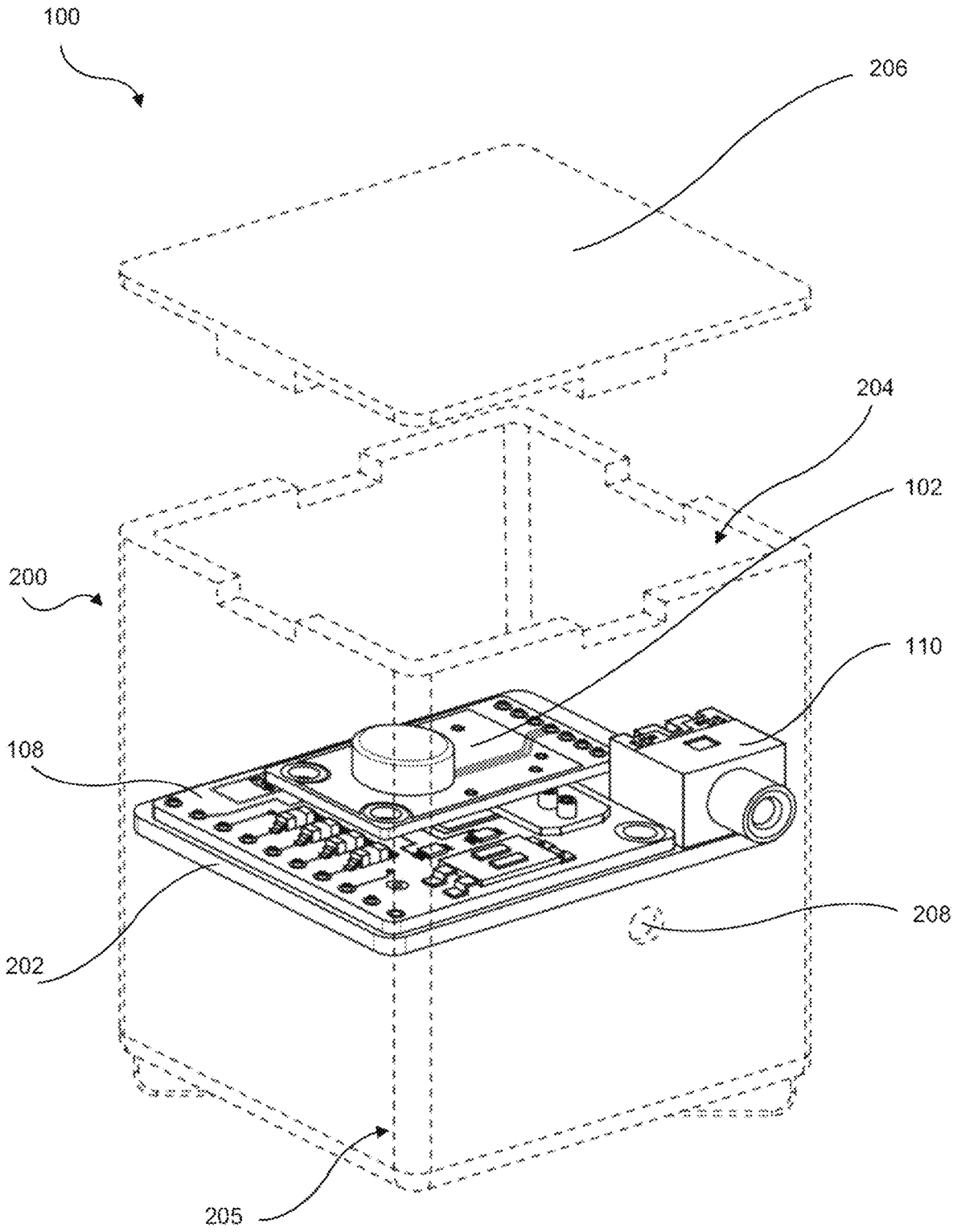
FIG. 2 depicts an exemplary low-cost hearing aid platform within a housing, according to an exemplary embodiment of the present invention.

FIG. 2 depicts an exemplary low-cost hearing aid platform 100 within a housing 200, according to an exemplary embodiment of the present disclosure. In some embodiments, a hearing aid platform 100 may comprise a printable circuit board (PCB) 202. In some embodiments, the electret microphone 102, the amplifier 108, and/or the capacitor (not shown in FIG. 2) may be disposed upon the PCB 202. The components may be soldered onto the PCB 202 to create the electrical connection for the components. In some embodiments, each component described herein may be connected by loose wiring instead of being connected via a PCB. The audio output 110 may be attached to the PCB 202, as shown in FIG. 2. In some embodiments, the audio output 110 may not be disposed upon a PCB 202 but instead be connected to an electret microphone 102 or an amplifier 108 by wires, allowing flexible placing within a housing 200. The PCB 202 may be manufactured from a rigid or a flexible material.

In some embodiments, a hearing aid platform 100 may have a housing 200. A housing 200 may have an internal cavity 204 that houses one or more of the components described herein, including one or more of the electret microphone 102, amplifier 108, capacitor, PCB 202, audio output 110, and power source (not shown in FIG. 2). In some embodiments, the audio output 110 may be disposed within the internal cavity 204 of the housing 200. In an embodiment wherein the audio output 110 is an audio jack, the audio jack may be disposed within the internal cavity 204, and the audio connection of the audio jack may extend at least partially from the internal cavity 204 and through a wall 205 of the housing 200. For example, a female-end connector of an audio jack may extend at least partially through a wall 205 of the housing 200 so that a male-end audio connector can be inserted into the audio jack. In some embodiments, a female-end connector of an audio jack may be flush with an internal wall 205 of the housing 200, i.e., flush with a wall 205 within the internal cavity 204. It is contemplated that the location at which the audio jack meets a wall 205 of the housing 200 may be water resistant, for example by either providing a gasket, adhesive, and/or the like as part of the housing 200 where the audio jack abuts the housing 200.

In some embodiments, a housing 200 may comprise a lid 206 to close the internal cavity 204 of the housing 200. The lid 206 may be placed upon the housing 200 when the internal components of the hearing aid platform 100 are placed within the internal cavity 204. Although not required for a hearing aid platform 100, the connection between the lid 206 and the housing 200 may be waterproof, for example by providing a gasket, adhesive, and/or the like as part of the housing between the lid 206 and other portions of the housing 200. In some embodiments, a housing 200 may have an aperture 208 extending from an area outside the housing 200, through a wall 205, and into the internal cavity 204. The aperture 208 may be provided to allow sound to enter the housing 200 to be received by the electret microphone 102. In some embodiments, a housing 200 may not comprise an aperture 208, for example if a waterproof construct is desired.

It is contemplated that the housing 200 and/or the lid 206 may be manufactured from a variety of materials. Since the intent of a hearing aid platform 100 is to provide an inexpensive device that is available to a large number of people, it is contemplated that the housing 200 and the lid 206 remain inexpensive to manufacture. In some embodiments, the housing 200 and/or the lid 206 may be manufactured from cardboard or wood. In some embodiments, the housing 200 and/or the lid 206 may be manufactured from a pre-manufactured polymer, including acrylics and/or other plastics.

In some embodiments, the housing 200 and/or the lid 206 may be custom made. Current advancements in 3D printing allow a user to print a custom housing 200 and/or lid 206 at a very low price. Printers are becoming more prevalent in society due to their low cost, which can be as low as a few hundred dollars. The cost of the materials or polymers used in printing have also decreased to allow greater access to the method of manufacturing. The great number of materials and/or polymers on the market also allow a user to customize the housing 200 and/or the lid 206 based on a number of desired characteristics. For example, if a user wishes to have a robust and solid hearing aid platform 100, the user may choose from a number of solid and durable polymers. If a user wishes to have a water-resistant hearing aid platform, the user may choose from water-resistant polymers. It is also contemplated that a user may desire a flexible housing 200, and a user may choose from a number of flexible polymers. The polymers that may be used for a housing 200 and/or a lid 206 may include, but are not limited to, acrylonitrile butadiene styrene, polylactic acid, polycarbonate, polyacrylic resins, polypropylene, polyethylene terephthalate, thermoplastic polyurethanes, thermoplastic elastomers, and/or the like. Any of these materials or combinations of these materials may be used. Also, printing a housing 200 and/or lid 206 allows a user to customize both the shape and color of the components. Providing a customizable housing may further decrease the social stigma of wearing a hearing aid, as the user can choose to manufacture the product based on the individual's personality and the individual's preferred method of using the device.

In some embodiments, a housing 200 may form a wearable device. Forming a wearable device can be understood to mean that different articles that may be placed at different parts of the body may be incorporated into the housing 200. For example, in some embodiments, the housing 200 may be a body-worn device that forms all or part of a necklace, a neck band, glasses, a head band, a hat, and/or the like. In some embodiments, and as described above, a PCB 202 may be rigid or flexible. Accordingly, a rigid PCB 202 may be incorporated into a rigid housing 200 to maintain a robust and solid device. A flexible PCB 202 may be incorporated into a flexible housing 200 to provide seamless integration into clothing or other accessories, including, but not limited, to jewelry, head bands, caps, hats, and/or the like.

Figure 3:
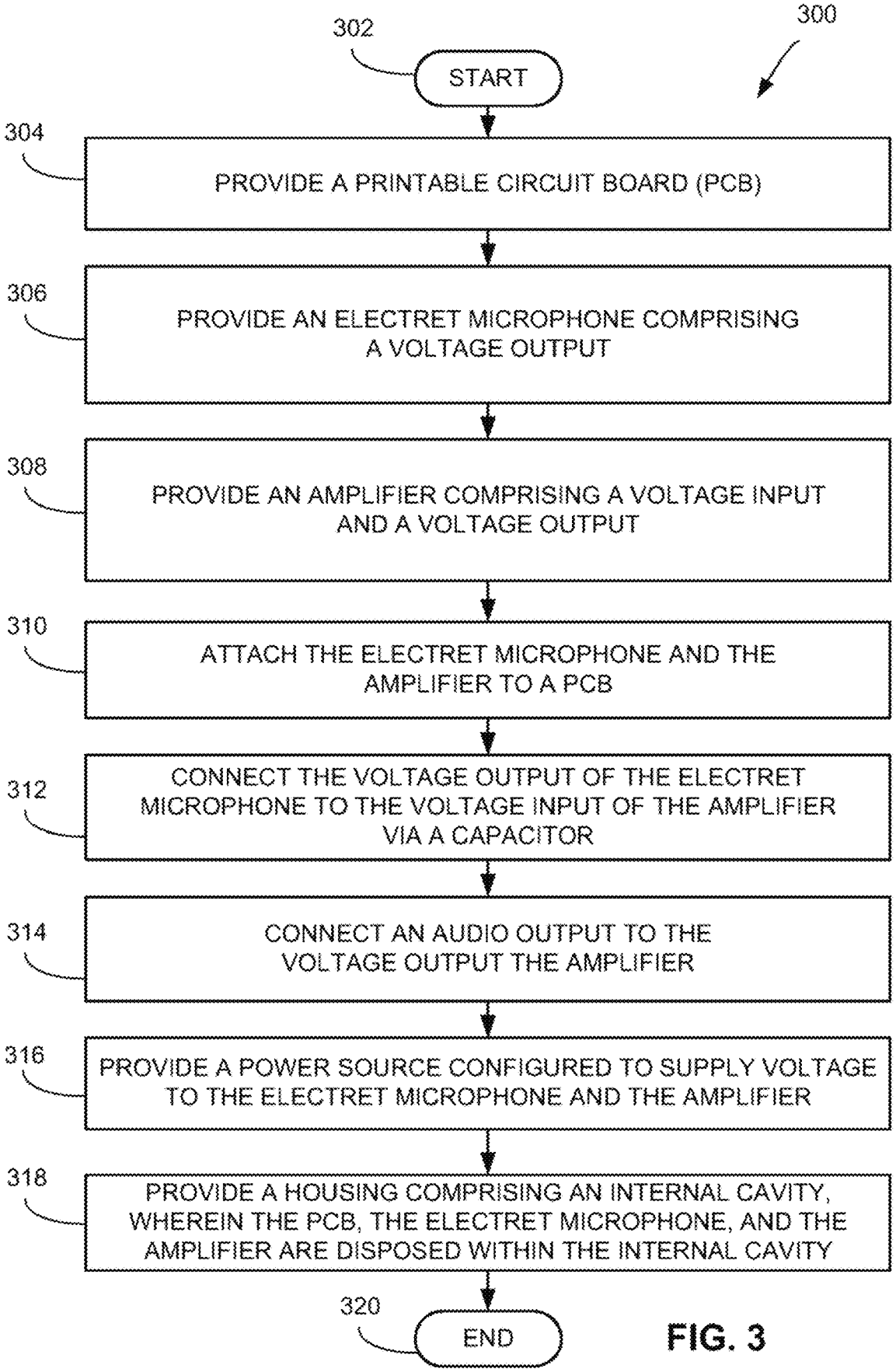
FIG. 3 is a flow diagram illustrating an exemplary method of manufacturing a hearing aid platform, according to an exemplary embodiment of the present invention.

FIG. 3 is a flow diagram illustrating method 300 that can be used to manufacture a hearing aid platform 100, according to an exemplary embodiment of the present disclosure. Method 300 is merely illustrative of certain methods of manufacturing a hearing aid and is not intended to be inclusive of all methods of manufacturing. Nonetheless, the flow diagram is illustrative of the capabilities of the present systems. As shown in FIG. 3, method 300 may begin 302 by providing 304 a printable circuit board (PCB). As described herein, the PCB may be provided to allow additional components of the device to be packaged neatly together. Also, the PCB may facilitate the electrical connections between the internal components.

Method 300 may further include providing 306 an electret microphone comprising a voltage output. The electret microphone may be any of the microphones described herein and may include any of the features described herein, including but not limited to selectable gain and automatic gain control. Method 300 may include providing 308 and amplifier comprising a voltage input and a voltage output. As described herein, the amplifier may be provided after the electret microphone to further increase the gain of the output signal and/or to increase the power output of the signal. Method 300 may include attaching 310 the electret microphone and the amplifier to the PCB. This step 310 may include soldering the electret microphone and the amplifier to the PCB.

Method 300 may further include connecting 312, via a capacitor, the voltage output of the electret microphone to the voltage input of the amplifier. Again, this step 312 may include soldering the electret microphone and the amplifier to electrical connections on the PCB that allows a capacitor to be placed between the voltage output of the microphone and the voltage input of the amplifier. The capacitor may be used to, inter alia, adjust the attack time of the hearing aid. As described herein, in some embodiments a greater capacitance rating of a capacitor may correspond to a longer attack time. This, along with an attack/release ratio, may be used to customize the safety features of the hearing aid.

Method 300 may further include connecting 314 an audio output to the voltage output of the amplifier. As described herein, in some embodiments, an audio output may include an audio jack that can be connected to a hearing device for the user. In this case, the audio jack may be either disposed upon the PCB or may be connected with loose wiring to the voltage output of the amplifier. In some embodiments, the audio output may be a pin in electrical connection with the voltage output of the amplifier. In these embodiments, a hearing device for the user may be directly connected to the pin of the audio output.

Method 300 may further comprise providing 316 a power source configured to supply voltage to the electret microphone and the amplifier. Any of the batteries described herein can be used for the hearing aid. For example, the power source can comprise one or more double-A batteries, one or more triple-A batteries, a lithium ion polymer batter, and/or the like. In some embodiments, the batteries may provide the voltage requirements for operating the microphone and/or the amplifier. This means that, in some embodiments, more than one battery may be placed in series to increase the voltage supply of the power source. It is contemplated that the power source supplies a voltage of from between approximately 3.0V and approximately 4.5V, which corresponds to the voltage requirements for exemplary electret microphones and amplifiers described herein.

Method 300 may further comprise providing 318 a housing comprising an internal cavity, wherein the PCB, the electret microphone, and the amplifier are disposed within the internal cavity of the housing. The housing may be manufactured from any of the materials described herein, including but not limited to wood, cardboard, and/or premade plastic materials. In some embodiments, the housing may be custom made by 3D printing the housing. In some embodiments, the power source and the audio input may also be disposed within the housing.

The housing may be manufactured in a manner that allows the device to be placed and worn at several positions on the body. For example, some embodiments include a housing that is made to be body worn (e.g., as a necklace and the like) or to provide a behind-the-ear design. According to the World Health Organization, behind-the-ear and body-worn configurations are preferred over in-the-ear configurations due to the collection of debris and other particles in the ear canal. However, in-the-ear configurations may also be provided with the current devices. Method 300 may end 320 at this step.

Figure 4:
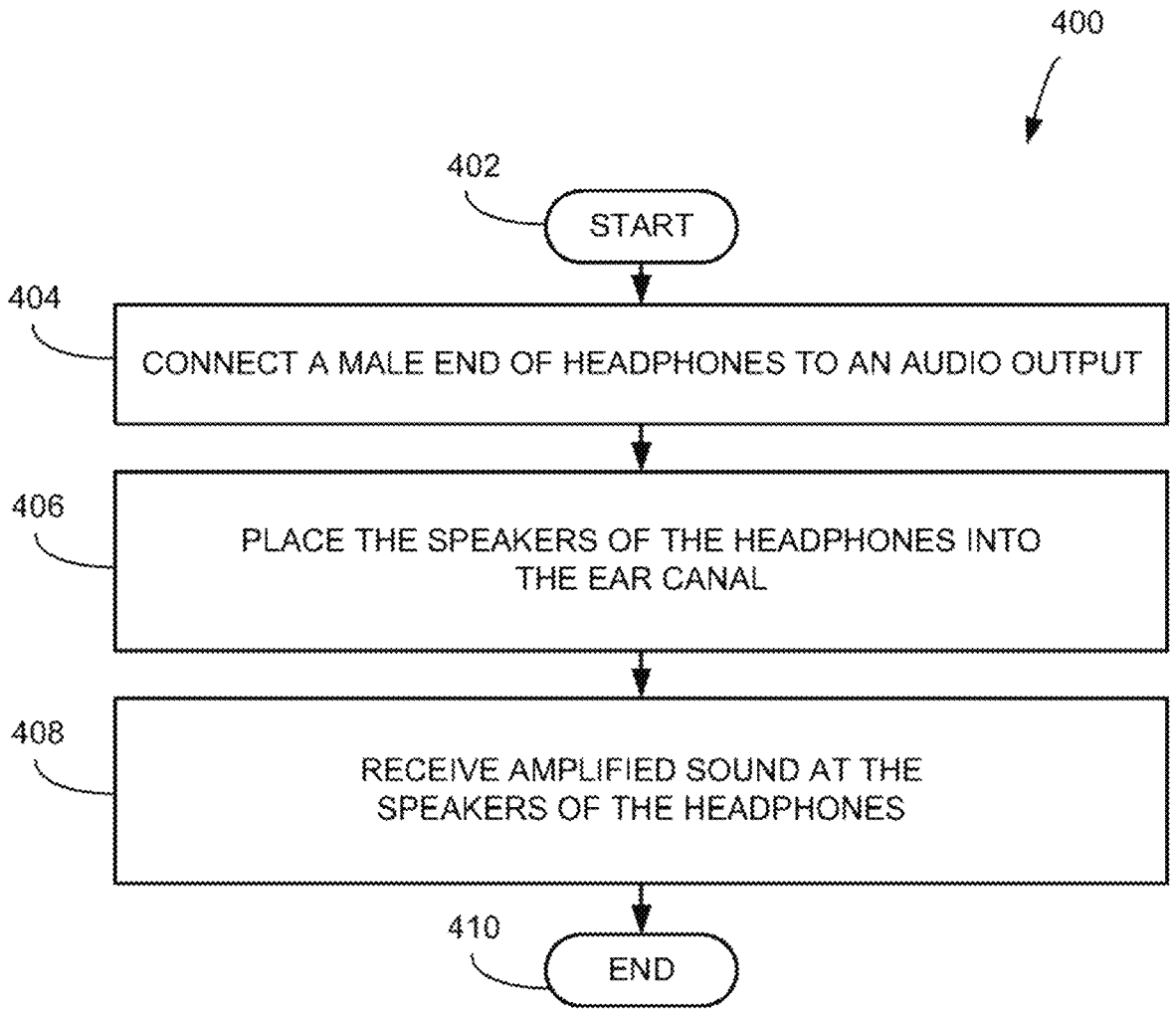
FIG. 4 is a flow diagram illustrating using an exemplary hearing aid platform with common headphones, according to an exemplary embodiment of the present invention.

The method 300 as illustrated in FIG. 3 can further include one or more of the steps outlined in FIG. 4. Referring to FIG. 4, method 400 may begin 402 by connecting 404 a male end of headphones to an audio output. As described herein, an audio output may be an audio jack configured to connect to standard headphones. Method 400 may further include placing 406 the speakers of the headphones into the ear canal. Method 400 may further include receiving 408 amplified sound at the speakers of the headphones. Method 400 may end 410 at this step.

Figure 5:
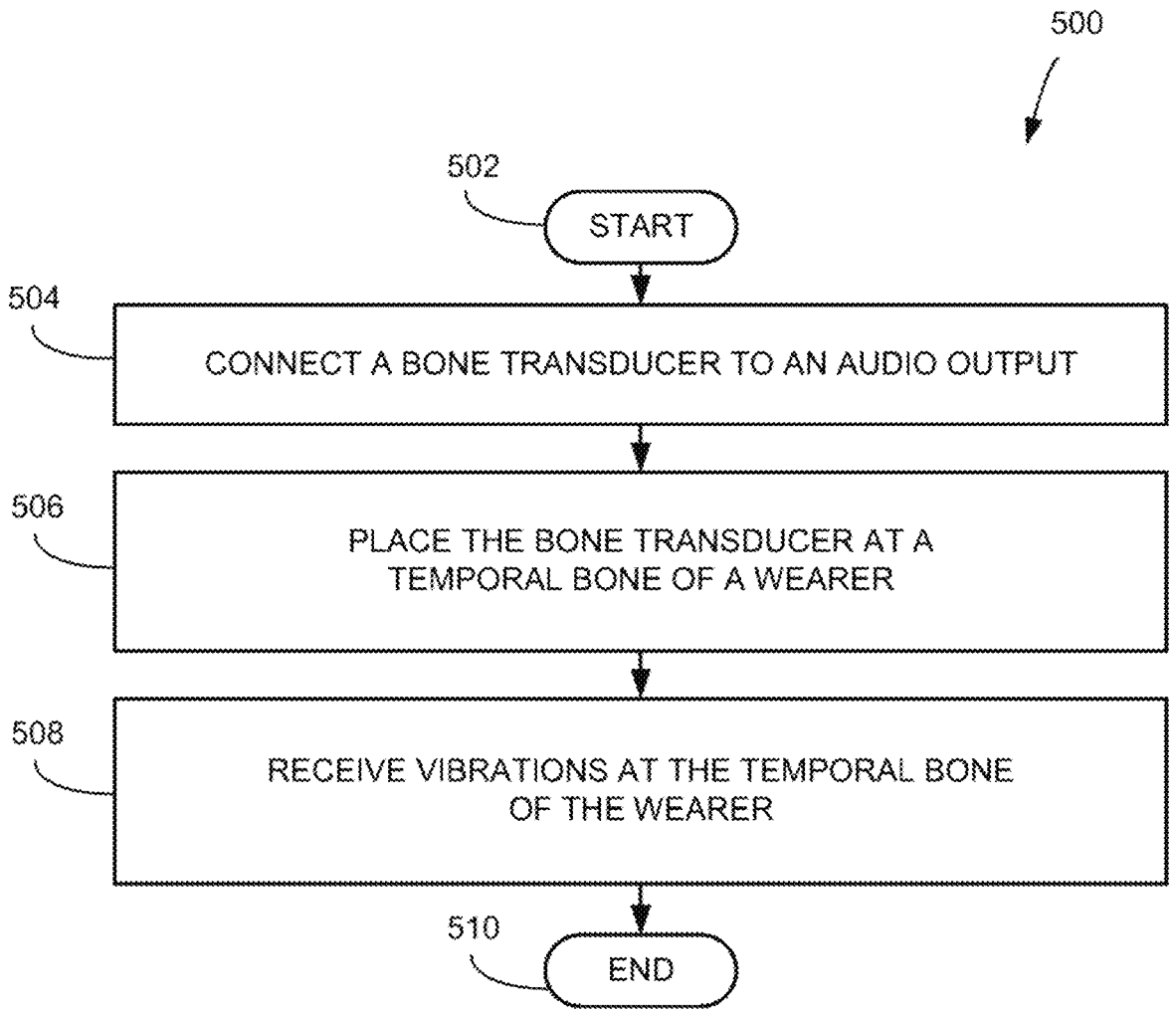
FIG. 5 is a flow diagram illustrating using an exemplary hearing aid platform with a bone transducer, according to an exemplary embodiment of the present invention.

The method 300 as illustrated in FIG. 3 can further include one or more of the steps outlined in FIG. 5. Referring to FIG. 5, method 500 may begin 502 by connecting 504 a bone transducer to an audio output. In some embodiments, the bone transducer may be wired to the audio output. Method 500 may further include placing 506 the bone transducer at a temporal bone of a wearer. In some embodiments, this step 506 may include placing the bone transducer at the temporal bone and manually holding the bone transducer at the temporal bone. In some embodiments, the bone transducer may be disposed within glasses, a headband, a hat, or other any other device that may contact the temporal bone of the wearer. Method 500 may further include receiving 508 vibrations at the temporal bone of the wearer. As described above, the ear canal is not the only way to "hear." Another method is to send vibrations through the temporal bone (behind the ear) of the skull so that vibrations are received by the cochlea, which then transforms vibrations into an auditory signal. Method 500 may end 510 at this step.

Experimental Section

The following section presents results from testing exemplary hearing aid platforms in accordance with some embodiments descried herein. The following embodiments are not inclusive of all device designs described within this disclosure.

The exemplary device used for testing comprised an electret microphone, a 1000 μF capacitor, a Class D stereo amplifier, and a standard 3.5 mm audio jack. The electret microphone included a preamplifier with a fixed 12 dB gain, a variable gain amplifier that adjusts the gain from 20 dB to 0 dB depending on the automatic gain control threshold (i.e., the gain maximum), and an output amplifier. The output amplifier allowed for selectable gains of 8 dB, 18 dB, and 28 dB, which provided an overall selectable output gain of 40 dB, 50 dB, or 60 dB. As discussed above, these gains can vary with the frequency of the input signal, with lower gains and lower input frequencies and higher gains at higher input frequencies. The electret microphone also provided variable attack/release ratios, which, depending on the logic used, allowed for ratios of 1:500, 1:2000, and 1:4000. In the experiment, an attack/release ratio of 1:500 was selected for the device.

The Class D amplifier had a high 75 dB power supply rejection ratio, a low 0.04% total harmonic distortion noise, and a signal-to-noise ratio in excess of 90 dB. The 2.0 mA quiescent current, with a low-power shutdown mode (0.01 μA), of the amplifier enabled the prototype to last ~3 weeks on one battery charge. Thus, the low-cost device is a significant improvement over previous devices that need battery replacement every day, thereby reducing battery costs.

A PCB was fabricated for the hearing aid device. The electrical components were placed with at least 0.2 mm spacing between the routes to minimize EMI noise between the signals. The PCB board was designed for compact 3D placement of the components. The electret microphone, the amplifier, and the capacitor were soldered to the PCB using 60/40 Sn—Pb solder alloy, and the audio jack was connected to the output of the amplifier by wires to allow for flexible placing within the housing. Common wired headphones with two speakers were connected to the audio jack. Three types of housings were used on the devices, including a cardboard box, a laser-cut acrylic box, and a 3D-printed polymer box made from polyacrylic resin. The power source was two double-A batteries. The power source is modular, and the device could also work with triple-A batteries and/or a lithium ion polymer battery.

The device was tested in an AudioScan Verifit 2 machine in ANSI Testing Mode. The hearing device was placed inside the Verifit chamber, with one speaker of the headphones puttied to the 2 cc couplers of the Verifit machine and one speaker completely sealed. The ANSI OSPL 90, Total Harmonic Distortion, and Equivalent Input Noise for the device was analyzed in the Verifit machine.

Figure 6:
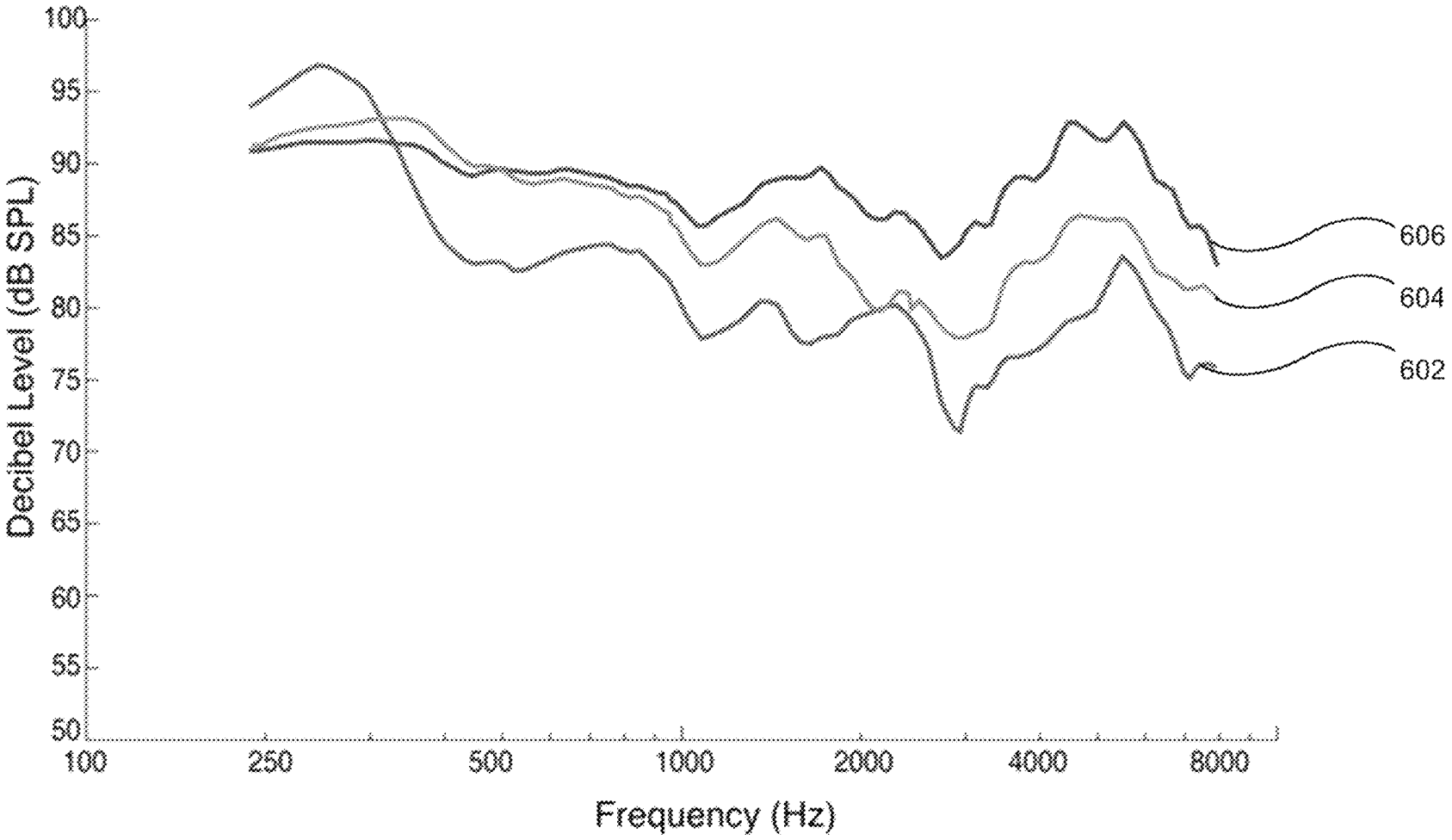
FIG. 6 is a graph of the OSPL 90 frequency curves for a hearing aid prototype, according to an exemplary embodiment of the present invention.

FIG. 6 is a graph of the OSPL 90 frequency curves for the hearing aid prototype. The graph shows the OSPL 90 results at four gain levels: 40 dB (line 602), 50 dB (line 604), and 60 dB (line 606). The results indicate preferential sound amplification in the high-frequency region from 4-8 kHz, with modest gain in the 1-2 kHz region, indicating a good profile for targeting people with ARHL. The results also show a significant improvement over previous low-cost systems. As described above, current affordable direct-to-consumer devices tend to have too high of gain in the low frequency region (<500 Hz) and too little gain in the high frequency region (>3 kHz). The 60 dB configuration (line 606), for example, shows a highest gain level at approximately 5 kHz, and the configuration also shows gain levels above 85 dB SPL for the frequency range of from approximately 3 kHz and 7 kHz. The results, therefore, show the present systems provide a good solution for individuals with ARHL, who may be less responsive to vibrations at high frequencies (>4000 Hz). Additional testing of the device indicates the prototype also closely matched the WHO recommended parameters for hearing aids, as shown in Table 2.

TABLE 2

| Parameter | Recommendation | Prototype Results |
|---|---|---|
| Maximum OSPL 90 | 100-130 dB SPL ± 4 dB | 97 dB SPL |
| OSPL 90 at 1 kHz | 90-124 dB SPL ± 4 dB | 90 dB SPL |
| Total Harmonic Distortion at 70 dB SPL input | 500 Hz <8%<br>800 Hz <8%<br>1500 Hz <2% | 500 Hz - <1%<br>800 Hz - <1%<br>1500 Hz - <1% |
| Equivalent Input Noise | <30 dB SPL @ 1 kHz | 22 dB ± 4 dB SPL |

TABLE 2-continued

| Parameter | Recommendation | Prototype Results |
|---|---|---|
| Battery Current Drain | ≤1 mA | $1.1 \times 10^{-3}$ A |
| Battery Life | 2-3 weeks | 20 Days |

Figure 7A:
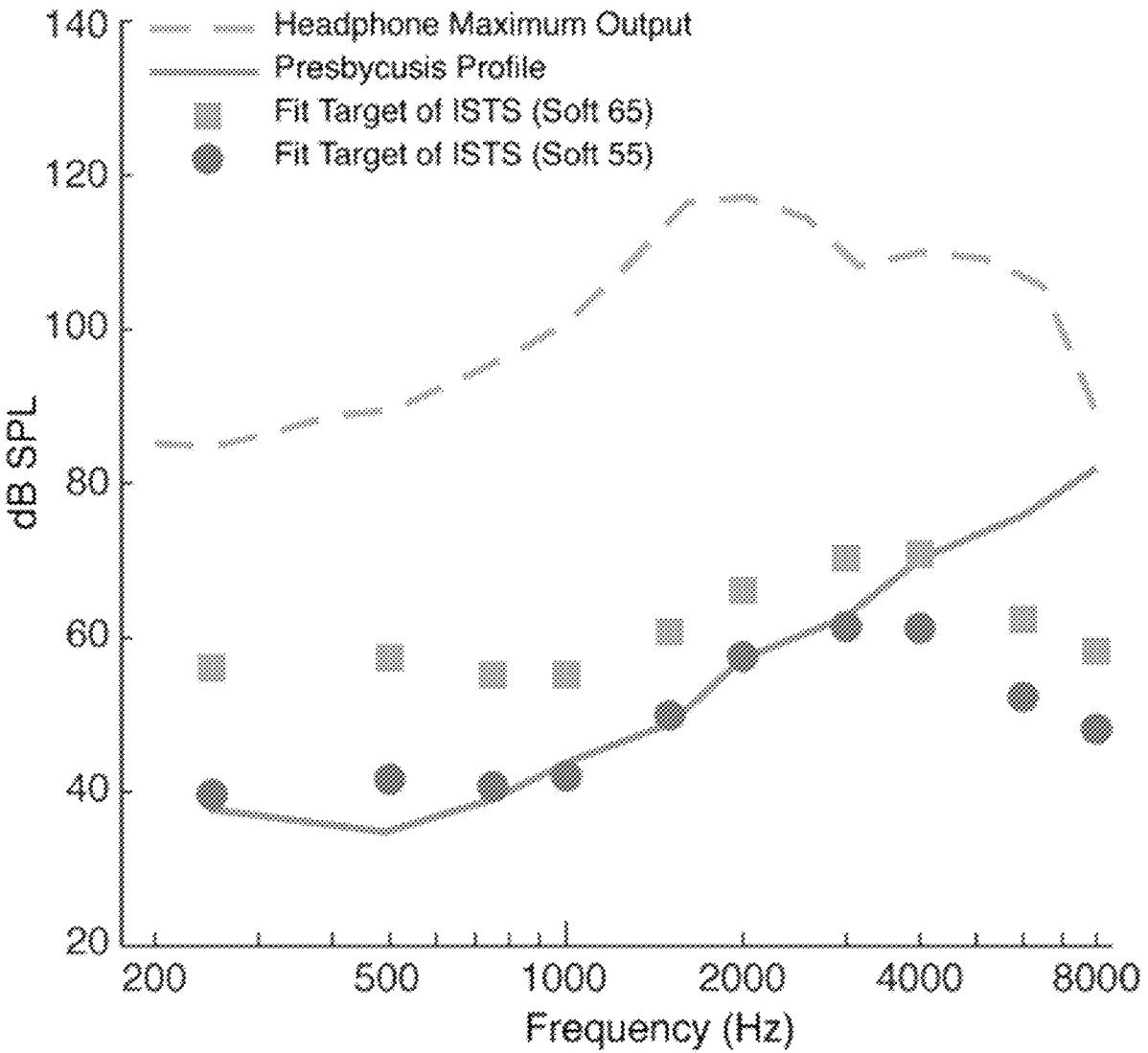
FIG. 7A is a generalized ARHL target curve used to generate fit targets using NA-NL2 fitting target specification at 55 and 65 dB.
Figure 7B:
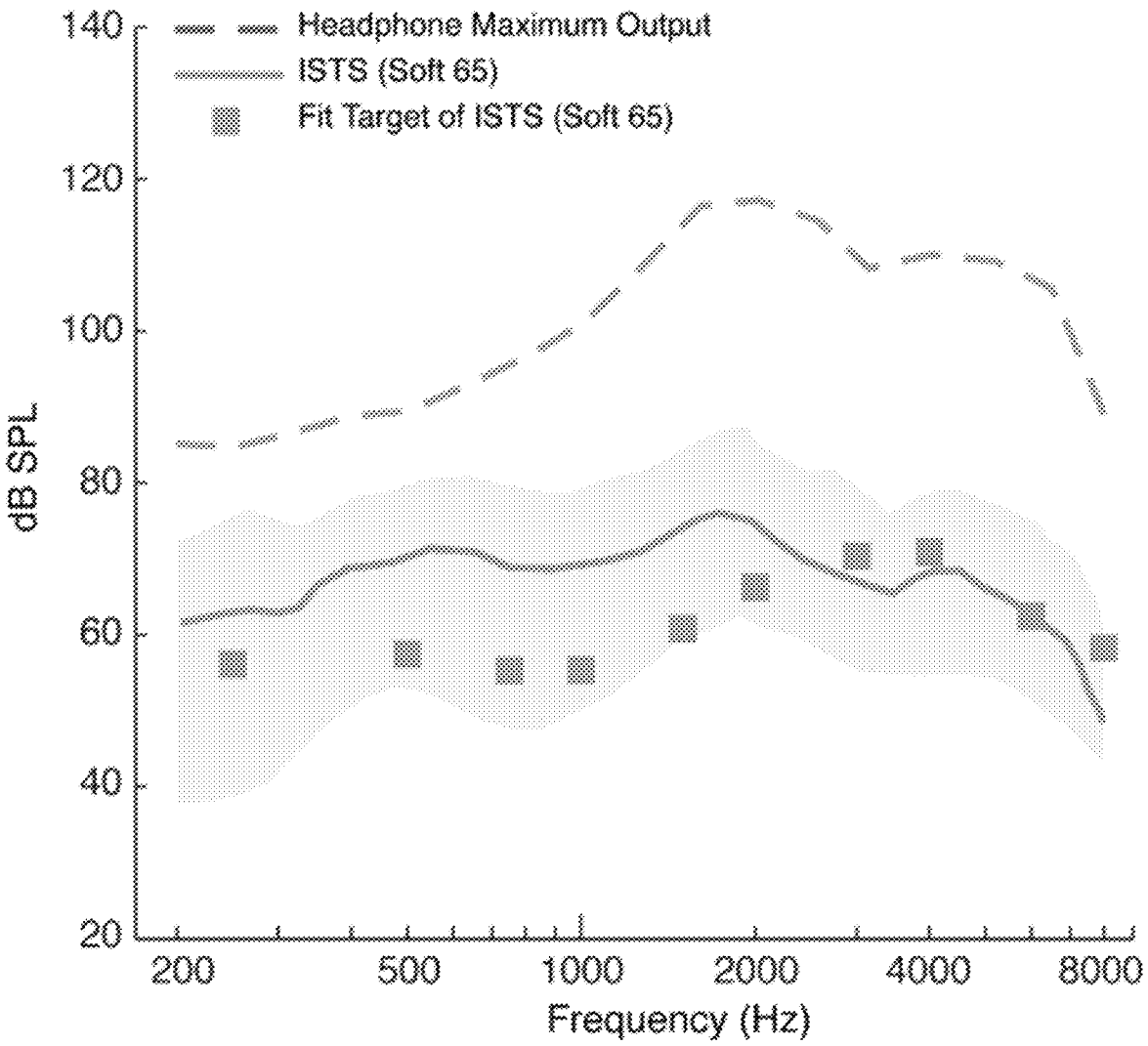
FIG. 7B is a graph showing the output curves for an exemplary hearing aid prototype at a 65 dB input level.
Figure 7C:
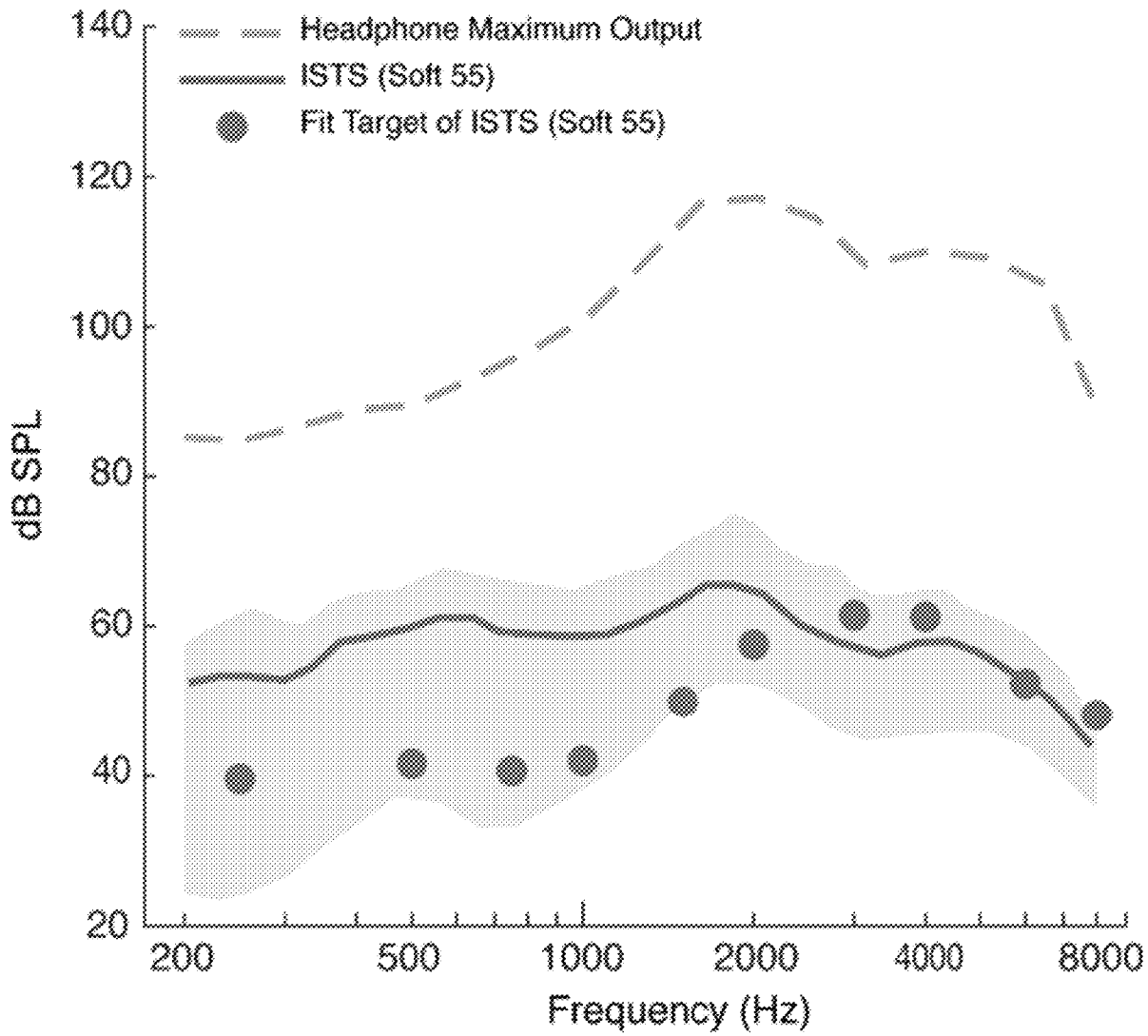
FIG. 7C is a graph showing the output curves for an exemplary hearing aid prototype at a 55 dB input level.

Using a generalized presbycusis dB SPL profile, NA-NL2 fitting targets were calculated for the International Speech Test Signal (ISTS) at 65 dB SPL and 55 dB SPL. FIGS. 7A-7C show the results of this testing protocol. FIG. 7A shows the generalized presbycusis curve and the fitting parameters for the curve using NA-NL2 fitting target specifications. FIG. 7B is a graph of the output curves tested at 65 dB SPL. The shaded area represents the variance for the output ISTS (Soft 65 dB) curve, and the solid line represents the ISTS 65 dB fit curve. FIG. 7C is a graph of the output curves tested at 55 dB SPL. The shaded area represents the variance for the output ISTS (Soft 55 dB) curve, and the solid line represents the ISTS 55 dB fit curve. As can be seen from FIGS. 7B-7C, the low-cost prototype meets the target for high frequencies (>2000 Hz) and is within the variance-threshold for the entire frequency range.

Finally, and because the rationale behind the present disclosure is the accessibility of hearing aid platforms, cost should be considered in the development strategy for a hearing aid. Table 3 provides an estimate of the total cost of an exemplary device, as described herein, if produced in a volume of greater than 10,000 units. Given that most hearing aids on the market can cost anywhere from between $500 and $3000, the devices described herein may reduce cost by more than 99% while maintaining performance and customizability.

TABLE 3

| Components | Cost |
|---|---|
| Headphones | 0.04 |
| Audio jack | 0.03 |
| 1000 μF capacitor | 0.04 |
| PCB | 0.05 |
| Electret microphone | 0.10 |
| Amplifier | 0.48 |
| AA alkaline battery | 0.02 |
| Total Cost | $0.76 |

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

What is claimed is:

1. A device comprising:

an electret microphone;

an amplifier;

a capacitor;

a printable circuit board (PCB), wherein the electret microphone, the amplifier, and the capacitor are disposed upon the PCB;

an audio output in electrical communication with the amplifier;

a power source in electrical communication with the PCB; and non-processor gain control;

wherein the non-processor gain control is configured to control gain of the device free of signal processing from a signal processor; and wherein a total harmonic distortion of the device, when the microphone is subjected to a 70 dB sound input, is less than 1% at each of 500 Hz, 800 Hz, and 1500 Hz.

2. The device of claim 1, wherein the non-processor gain control comprises one or more of adjustable gain settings and automatic gain control of the microphone; and wherein the power source is configured to supply a voltage of from between approximately 3.0V and approximately 4.5V.

3. The device of claim 1, wherein the non-processor gain control comprises one or more of adjustable gain settings and automatic gain control of one or more of the microphone, the amplifier and the capacitor; and wherein the power source is one or more batteries configured to supply a voltage of from between approximately 3.0V and approximately 4.5V.

4. The device of claim 1, wherein the microphone has an attack/release ratio of from between 1:500 and 1:2000.

5. The device of claim 1, wherein the audio output is selected from the group consisting of an audio jack configured to output a signal to headphones and audio output configured to output a signal to a bone transducer.

6. A device comprising:

a microphone;

an amplifier;

a capacitor;

a printable circuit board (PCB), wherein the microphone, the amplifier, and the capacitor are disposed upon the PCB;

an audio output in electrical communication with the amplifier; and a power source in electrical communication with the PCB;

wherein a total harmonic distortion of the device, when the microphone is subjected to a 70 dB sound input, is less than 1% at each of 500 Hz, 800 Hz, and 1500 Hz.

7. The device of claim 1 further comprising a housing containing one or more of the electret microphone, amplifier, capacitor, PCB, audio output, and power source;

wherein the electret microphone has an attack/release ratio of from between 1:500 and 1:2000;

wherein the amplifier is configured to one or both increase the gain of a signal from microphone and increase the power of the signal from microphone; and wherein the device does not comprise a digital signal processor.

8. The device of claim 6, wherein the power source is configured to supply a voltage of from between approximately 3.0V and approximately 4.5V.

9. The device of claim 6, wherein the power source is selected from the group consisting of one or more double-A batteries, one or more triple-A batteries, and a lithium ion polymer battery.

10. The device of claim 6, wherein the audio output is selected from the group consisting of an audio jack configured to output a signal to headphones and audio output configured to output a signal to a bone transducer.

11. A device comprising:

an electret microphone comprising:

a preamplifier with a fixed gain;

a variable gain amplifier; and an output amplifier;

an amplifier a capacitor;

a printable circuit board (PCB), wherein the microphone, the amplifier, and the capacitor are disposed upon the PCB;

an audio output in electrical communication with the amplifier;

a power source in electrical communication with the PCB; and a housing containing one or more of the microphone, amplifier, capacitor, PCB, audio output, and power source;

wherein the microphone has an attack/release ratio of from between 1:500 and 1:2000;

wherein the amplifier is configured to one or both increase the gain of a signal from microphone and increase the power of the signal from microphone; and wherein the device does not comprise a digital signal processor.

12. A hearing aid made by a process comprising:

attaching an electret microphone and an amplifier to a printable circuit board (PCB);

connecting, via a capacitor, a voltage output of the electret microphone to a voltage input of the amplifier;

connecting an audio output to a voltage output of the amplifier; and supplying voltage to the electret microphone and the amplifier;

wherein a total harmonic distortion of the hearing aid, when the microphone is subjected to a 70 dB sound input, is less than 1% at each of 500 Hz, 800 Hz, and 1500 Hz.

13. The hearing aid made by the process of claim 12, wherein the audio output is an audio jack comprising a female-end receptacle;

wherein the audio jack is disposed at least partially within an internal cavity of a housing; and wherein the female-end receptacle extends at least partially from the internal cavity and through the housing.

14. The hearing aid made by the process of claim 13, wherein the housing and the audio jack are water resistant.

15. The hearing aid made by the process of claim 13, wherein the housing comprises a three-dimensional printed polymer.

16. The hearing aid made by the process of claim 12, wherein the microphone has an attack/release ratio of from between 1:500 and 1:2000.

17. The device of claim 7, wherein the housing forms a wearable device selected from the group consisting of a necklace, a neck band, glasses, and a hat.

18. The device of claim 11, wherein a total harmonic distortion of the device, when the microphone is subjected to a 70 dB sound input, is less than 1% at each of 500 Hz, 800 Hz, and 1500 Hz.

19. The device of claim 11, wherein:

the preamplifier has a fixed 12 dB gain;

the variable gain amplifier is configured to adjust the gain from 20 dB to 0 dB depending on an automatic gain control threshold;

the output amplifier is configured for selectable gains of at least 8 dB, 18 dB, and 28 dB; and the amplifier is Class D stereo amplifier.

20. The device of claim 6, wherein:

the microphone has an attack/release ratio of from between 1:500 and 1:2000;

the amplifier is a Class D stereo amplifier having a 75 dB power supply rejection ratio, a 0.04% total harmonic distortion noise, and a signal-to-noise ratio in excess of 90 dB; and the capacitor is a 1000 μF capacitor.

21. The device of claim 6 further comprising a housing containing one or more of the microphone, amplifier, capacitor, PCB, audio output, and power source;

wherein the housing forms at least a part of a wearable device.

22. The device of claim 21, wherein the wearable device is selected from the group consisting of a necklace, a neck band, glasses, a head band, and a hat.

23. The hearing aid made by the process of claim 12, the process further comprising customizing the shape of the hearing aid.

24. The hearing aid made by the process of claim 12, the process further comprising customizing the color of the hearing aid.

* * * * *